US006700324B2

(12) United States Patent
Bechtel et al.

(10) Patent No.: US 6,700,324 B2
(45) Date of Patent: Mar. 2, 2004

(54) PLASMA PICTURE SCREEN WITH IMPROVED WHITE COLOR POINT

(75) Inventors: Hans-Helmut Bechtel, Roetgen (DE); Wolfgang Busselt, Roetgen (DE); Joachim Opitz, Aachen (DE); Harald Glaeser, Aachen (DE); Thomas Juestel, Aachen (DE); Volker Van Elsbergen, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 33 days.

(21) Appl. No.: 10/139,200

(22) Filed: May 6, 2002

(65) Prior Publication Data

US 2003/0038598 A1 Feb. 27, 2003

(30) Foreign Application Priority Data

May 8, 2001 (DE) ..... 101 22 287

(51) Int. Cl.[7] ..... H01J 17/49
(52) U.S. Cl. ..... 313/587; 313/582; 313/586
(58) Field of Search ..... 313/582, 586, 313/587

(56) References Cited

U.S. PATENT DOCUMENTS 6,259,212 B1 * 7/2001 Song ..... 313/587

FOREIGN PATENT DOCUMENTS

DE 19937420 12/2000 ..... H01J/1/63

* cited by examiner

*Primary Examiner*—Vip Patel

(57) ABSTRACT

The invention relates to a plasma picture screen with a improved white color point. The front plate (1) of the plasma picture screen has a blue layer on the side facing the plasma discharge. This may be the dielectric layer (4), the protective layer (5), or an additional layer.

6 Claims, 3 Drawing Sheets

PLASMA PICTURE SCREEN WITH IMPROVED WHITE COLOR POINT

Figure 1:
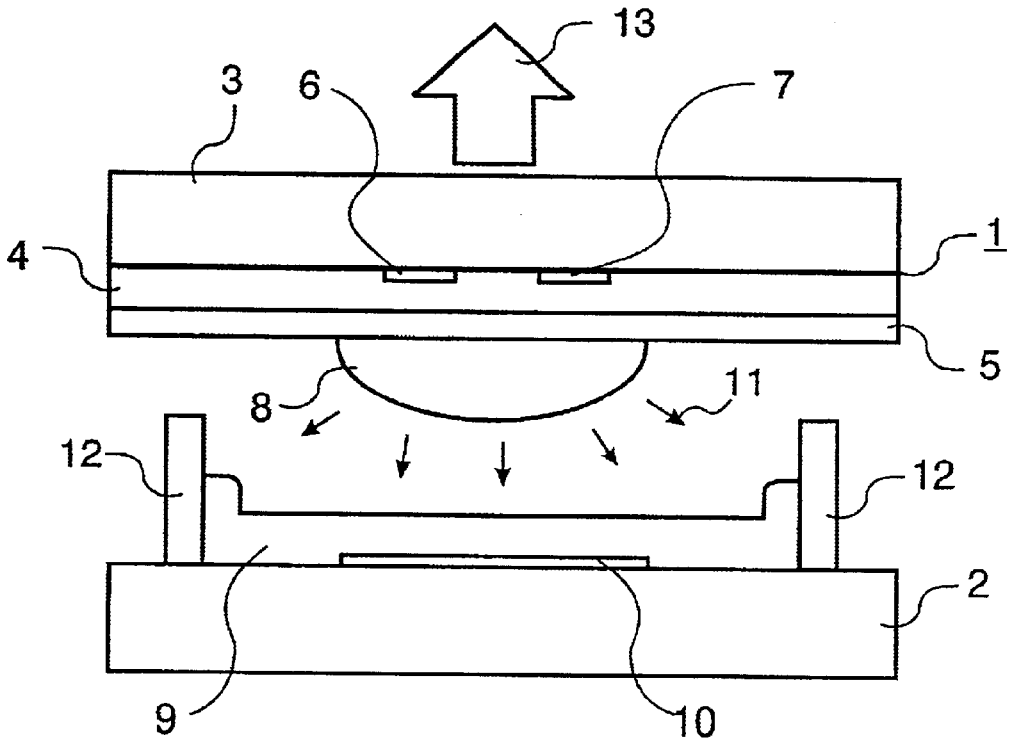

The invention relates to a plasma picture screen provided with a front plate which comprises a glass plate on which a dielectric layer and a protective layer are provided, with a carrier plate carrying a phosphor layer, with a ribbed structure which divides the space between the front plate and the carrier plate into plasma cells filled with a gas, and with one or more electrode arrays on the front plate and the carrier plate for generating corona discharges in the plasma cells.

Plasma picture screens render possible color images with high resolution and large screen diagonals and are of a compact construction. A plasma picture screen has a hermetically sealed glass cell filled with a gas, with electrodes in a grid arrangement. The application of a voltage triggers a gas discharge which generates light in the ultraviolet range. This light can be converted into visible light by phosphors and emitted through the front plate of the glass cells to a viewer.

Additive color mixing is used for showing color images on a plasma picture screen. Many of the colors present in nature can be displayed by additive mixing of the three primary colors, red, green, and blue of suitable relative intensities.

The display of the different colors is established by so-called standard color curves. A commonly used standard is the CIE color triangle. The range of displayable colors in a screen is defined by the color dots of the three phosphors, given by the respective emission spectra.

Owing to the characteristic color sensitivity of the human eye, the blue light emission contributes least to the luminance (brightness) of a screen. In addition, the blue-emitting phosphor is not as efficient as the green- and red-emitting phosphors in plasma picture screens. A plasma picture screen with a blue-emitting phosphor is known, for example, from DE 199 37 420. These two effects lead to the color temperature for white light for television applications, given an equal excitation of red-, green-, and blue-emitting phosphors, being lower than desired.

It is accordingly an object of the invention to avoid the disadvantages of the state of the art and to provide a plasma picture screen with an improved color temperature for white light.

This object is achieved by a plasma picture screen provided with a front plate which comprises a glass plate on which a dielectric layer and a protective layer are provided, with a carrier plate carrying a phosphor layer, with a ribbed structure which divides the space between the front plate and the carrier plate into plasma cells filled with a gas, and with one or more electrode arrays on the front plate and the carrier plate for generating corona discharges in the plasma cells, wherein the front plate has a blue layer on its side facing the plasma cells.

The blue layer achieves a blue coloration of the front plate, and hence the white color point of the plasma picture screen is shifted towards lower x,y values. The color temperature of the plasma picture screen is also raised by this coloration of the front plate.

In an advantageous embodiment, the blue layer is the protective layer. This has the advantage that no additional protective layer, for example of MgO, need be applied to the front plate.

In this advantageous embodiment, it may be preferred for the blue layer to be structured and to be parallel to the electrodes on the front plate. The addressing behavior of the plasma picture screen can be improved by this measure.

The blue layer can be produced in a simple manner by the application of blue colorant particles in the dielectric layer.

It may be advantageous for the blue layer to be applied as an additional layer on the glass plate and on the electrodes of the front plate.

It is particularly preferred if the blue layer contains colorant particles selected from the group comprising $CoAl_2O_4$ and blue ultramarines.

The inorganic pigments are temperature-stable and resist rigid conditions in the manufacture and operation of a plasma picture screen. In particular, blue layers which contain $CoAl_2O_4$ are resistant to the ion stream generated in a plasma discharge. Furthermore, $CoAl_2O_4$ has a high secondary electron coefficient under ion bombardment.

The invention will be explained in more detail below with reference to three Figures and six embodiments.

Figure 2:
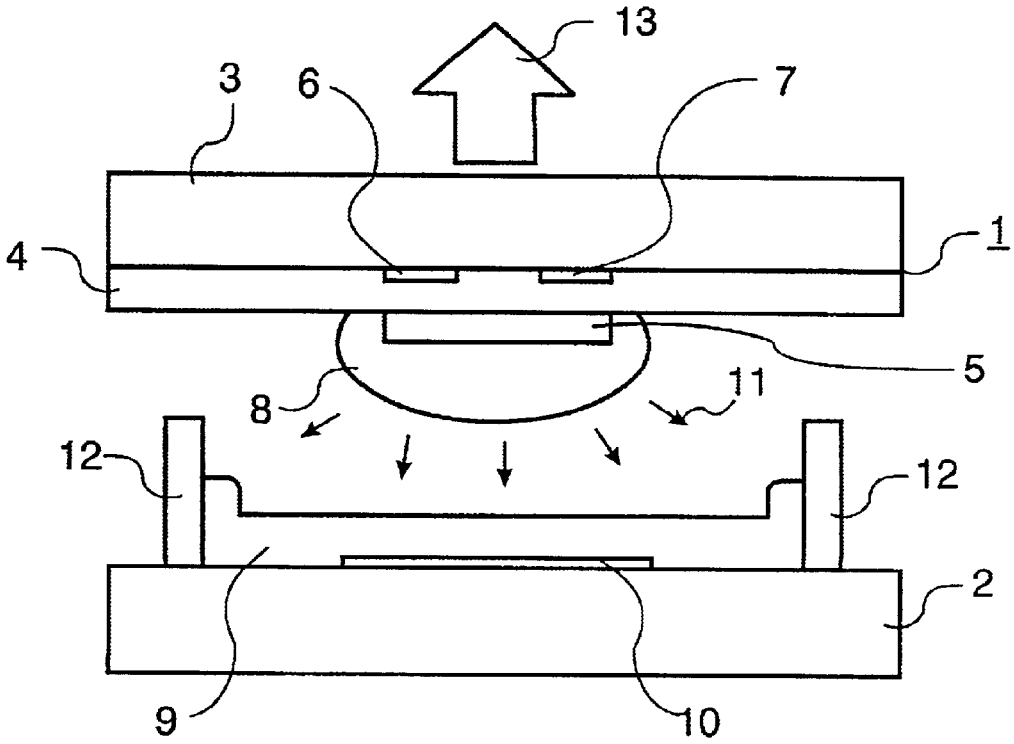
Figure 3:
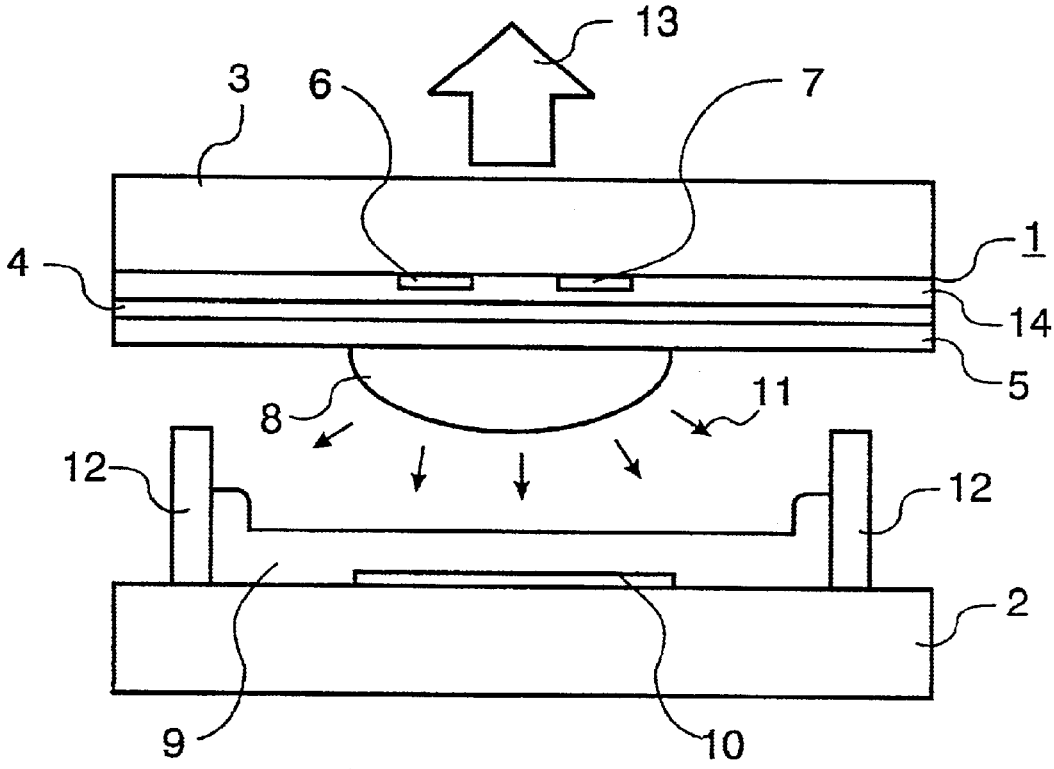

FIG. 1 shows the structure and operating principle of an individual plasma cell in an AC plasma picture screen, FIG. 2 shows the structure and operating principle of an individual plasma cell in an AC plasma picture screen with a blue layer on the glass plate and on the electrodes, FIG. 3 shows the structure and operating principle of an individual plasma cell in an AC plasma picture screen with a structured blue layer.

In FIG. 1, a plasma cell of an AC plasma picture screen with a coplanar arrangement of electrodes has a front plate 1 and a carrier plate 2. The front plate 1 comprises a glass plate 3 on which a dielectric layer 4 is applied with a protective layer 5 thereon. Parallel, strip-type discharge electrodes 6, 7 are applied on the glass plate 3 and are covered with the dielectric layer 4. The discharge electrodes 6, 7 are made, for example, of metal or ITO. The carrier plate 2 is made of glass, and parallel, strip-type address electrodes 10 of, for example, Ag are applied on the carrier plate 2 so as to extend perpendicularly to the discharge electrodes 6, 7. These address electrodes 10 are covered by a phosphor layer 9 which emits light in one of the three primary colors red, green, or blue. In addition, the phosphor layer 9 is divided into several color segments. Usually the red-, green-, or blue-emitting color segments of the phosphor layer 9 are applied in the form of vertical stripe triplets. The individual plasma cells are separated by a ribbed structure 12 with separating ribs of, preferably, a dielectric material.

A gas, for example a rare gas mixture of, for example, He, Ne, or Kr with Xe as the UV light-generating component, is present in the plasma cell and between the discharge electrodes 6, 7, which act alternately as the cathode and the anode. After ignition of the surface discharge, whereby charges can flow along a discharge path lying between the discharge electrodes 6, 7 in the plasma range 8, a plasma is formed in the plasma range 8 by which, depending on the composition of the gas, radiation 11 is generated in the UV range, in particular in the VUV range. This radiation 11 excites the phosphor layer 9 into luminescence, emitting visible light 13 in one of the three primary colors which issues through the front plate 1 and thus forms a luminescent pixel on the screen.

The front plate 1 of the plasma picture screen has a blue layer at the side of the plasma cells. This may be either the dielectric layer 4, the protective layer 5, or an additional layer 14. The additional layer 14 preferably lies on the glass plate 3 and on the discharge electrodes 6, 7. Alternatively, however, it may lie between the dielectric layer 4 and the protective layer 5 or between the glass plate and the discharge electrodes 6, 7.

Preferably, the blue layer contains colorant particles which are selected from the group of $CoAl_2O_4$ and blue ultramarines.

If the blue layer is to be the protective layer 5, a layer of $CoAl_2O_4$ with a thickness of 300 to 1500 nm is applied on the dielectric layer 4, which preferably comprises a PbO-containing glass. This may be done by means of vapor deposition of CoO and $Al_2O_3$ in vacuum or by wet chemical application of a suspension containing $CoAl_2O_4$. The particle diameter of the $CoAl_2O_4$ particles of such a suspension is preferably less than 200 nm. Alternatively, the blue layer may be made of $CoAl_2O_4$ by means of silk screen printing or other printing processes.

It may be advantageous in this embodiment for the $CoAl_2O_4$-containing protective layer 5 to be applied not over the entire surface of the dielectric layer 4, but in a structured manner. For example, as shown in FIG. 2, the $CoAl_2O_4$-containing protective layer 5 may be provided on the dielectric layer 4 in strips parallel to the discharge electrodes 6, 7. In this embodiment, the area between two pairs of discharge electrodes 6, 7 in which no plasma discharge occurs is not covered with the $CoAl_2O_4$-containing protective layer 5.

If the blue layer is to be the dielectric layer 4, blue colorant particles are mixed into the starting material used for making the dielectric layer 4. The starting material may be a glass material or a ceramic material. The dielectric layer 4 may contain one or more oxides selected from the group $Li_2O$, $Na_2O$, $K_2O$, $SiO_2$, $B_2O_3$, BaO, $Al_2O_3$, ZnO, MgO, CaO, and PbO, mixed with $CoAl_2O_4$ or ultramarines. The particle size of the colorant particles preferably lies between 20 and 5000 nm.

To manufacture a dielectric layer 4 which contains $CoAl_2O_4$ or ultramarine, a screen printing paste is first prepared from equal parts by weight of the screen printing paste base and the glass material or ceramic material. The screen printing paste base is preferably p-menth-1-en-8-ol with 5% by weight ethylcellulose. Furthermore, a colorant particle paste is prepared from the screen printing paste base and 70 parts by weight of colorant particles. Then the screen printing paste is mixed in a ratio of 10:1 with the colorant particle paste. The resulting paste is applied by means of silk screen printing on the front plate 1, which comprises a glass plate 3 and a discharge electrodes 6, 7. The dielectric layer 4 is dried and then the entire front plate 1 is exposed to a temperature of 485° C. The layer thickness of the finished dielectric layer 4 lies preferably between 20 and 40 $\mu$m.

Alternatively, the blue layer may be an additional layer 14. In this embodiment, a layer of colorant particles may be applied on the glass plate 3 or on the glass plate 3 and the discharge electrodes 6, 7, or between the dielectric layer 4 and the protective layer 5. FIG. 3 shows the plasma picture screen with an additional layer 14 which is applied to the glass plate 3 and the discharge electrodes 6, 7.

To produce a blue additional layer 14, suspensions with colorant particles are first applied to the front plate 1 by means of printing processes, doctor blade processes, or spin-coating processes and then dried. The layer thickness of the blue additional layer 14 is preferably between 0.1 and 2 $\mu$m. Alternatively, the blue additional layer 14 may be produced by means of known photolithographic processes or by means of vapor deposition of CoO and $Al_2O_3$ in vacuum.

A suspension provided on the front plate 1 by means of spin coating preferably contains a low concentration of dissolved auxiliary substances, for example organic polymer binders such as polyvinyl alcohol. The composition of the suspension of colorant particles is therefore advantageously selected such that the dissolved ingredients do not account for more than 20 percent by volume of the colorant particles. It is advantageous to limit the volume ratio of colorant particles to binder to 10:1.

Embodiments of the invention will now be described below, representing examples of how the invention may be implemented.

EXAMPLE 1

Discharge electrodes 6, 7 of ITO are placed on a glass plate 3 for the manufacture of a front plate 1 with a blue layer, which forms an additional layer 14. A suspension of $CoAl_2O_4$ and polyvinyl alcohol in a ratio of 10:1 is provided on the glass plate 3 and the discharge electrodes 6, 7 by means of spin coating. After drying, a blue additional layer 14 of $CoAl_2O_4$ with a layer thickness of 0.7 $\mu$m was obtained. A dielectric layer 4 of low-melting glass with a layer thickness of 30 $\mu$m was provided on the blue additional layer 14. A 70 nm thick protective layer 5 of MgO was applied to the dielectric layer 4 by vacuum deposition. Then the front plate 1 was used together with a carrier plate 2 and a xenon-containing gas mixture for building a plasma picture screen. The plasma picture screen had a color temperature of 8100 K. Furthermore, the luminance of the plasma picture screen was increased by 20 percent for the same contrast under ambient lighting.

EXAMPLE 2

A screen printing paste of 100 g p-menth-1-en-8-ol containing 5% by weight ethylcellulose and 100 g of a glass material ($T_g \approx 475°$ C.) containing $Li_2O$, $Na_2O$, $K_2O$, $SiO_2$, $B_2O_3$BaO, $Al_2O_3$, ZnO, MgO and CaO, was prepared for the manufacture of a front plate 1 with a blue dielectric layer 4 and was subsequently dispersed by double passage through a triple roller mill.

Also, 100 g p-menth-1-en-8-ol containing 5% by weight ethylcellulose was mixed with 70 g $CoAl_2O_4$. This colorant particle paste was dispersed by double passage through a triple roller mill.

The screen printing paste was mixed with the colorant particle paste in a ratio of 15:1 in a dissolver. After complete homogenization of the mixture, the resulting blue screen printing paste was applied to the front plate 1 of the plasma picture screen by silk screen printing. The resulting layer was dried and treated in an oven at 485° C. A transparent blue dielectric layer 4 of 35 $\mu$m thickness was obtained through deposition in vacuum. A 700 nm thick protective layer 5 of MgO was applied to the dielectric layer 4. Then the front plate 1 was used together with the carrier plate 2 and a xenon-containing gas mixture to build a plasma picture screen.

EXAMPLE 3

A screen printing paste of 100 g p-menth-1-en-8-ol containing 5% by weight ethylcellulose and 100 g of a glass material ($T_g \approx 475°$ C.) containing $Li_2O$, $Na_2O$, $K_2O$, $SiO_2$, $B_2O_3$, BaO, $Al_2O_3$, ZnO, MgO and CaO, was prepared for the manufacture of a front plate 1 with a blue dielectric layer 4 and was then dispersed by double passage through a triple roller mill.

Also, 100 g p-menth-1-en-8-ol containing 5% by weight ethylcellulose was mixed with 70 g ultramarine (C.I. Pigment Blue 299). This colorant particle paste was dispersed by double passage through a triple roller mill.

The screen printing paste was mixed with the colorant particle paste in a ratio of 15:1 in a dissolver. After complete homogenization of the mixture, the resulting blue screen printing paste was applied to the front plate 1 of the plasma picture screen by silk screen printing. The resulting layer was dried and treated in an oven at 485° C. A transparent blue dielectric layer 4 of 30 μm thickness was obtained. A 700 nm thick protective layer 5 of MgO was applied to the dielectric layer 4 by vacuum deposition. Then the front plate 1 was used together with the carrier plate 2 and a xenon-containing gas mixture to build a plasma picture screen.

EXAMPLE 4

An aqueous suspension of a dispersion agent and 9.5% by weight $CoAl_2O_4$ was prepared for the manufacture of a front plate 1 with a blue protective layer 5. The viscosity of this suspension was set to 100 mPa*s with polyvinyl alcohol. The suspension was applied to a dielectric layer 4 of a front plate 1 comprising a glass plate 3, a dielectric layer 4, and discharge electrodes 6, 7. The dielectric layer 4 contained PbO-containing glass and the two discharge electrodes 6, 7 were made of ITO. After drying at 150° C., a 600 nm thick blue layer was obtained which at the same time served as a protective layer 5. Then the front plate 1 was used together with the carrier plate 2 and a xenon-containing gas mixture to build a plasma picture screen. The white color point of the plasma picture screen was 7600 K.

EXAMPLE 5

100 g p-menth-1-en-8-ol containing 5% by weight ethylcellulose and 70 g $CoAl_2O_4$ were mixed for the preparation of a colorant particle paste. This paste was dispersed by double passage through a triple roller mill.

The colorant particle paste was printed in stripes onto the dielectric layer 4 of a front plate 1 comprising a glass plate 3, discharge electrodes 6, 7, and a dielectric layer 4. The colorant particle paste was applied such that one structured printed stripe lay opposite one pair of discharge electrodes 6, 7 between which a plasma discharge takes place each time. The distance between two printed stripes was 30 μm, and the layer thickness of a printed stripe after drying was 1.1 μm. The dielectric layer 4 contained PbO-containing glass and the two discharge electrodes 6, 7 were of ITO. Then the front plate 1 was used together with a carrier plate 2 and a xenon-containing gas mixture to build a plasma picture screen. The white color point of the plasma picture screen was 7600 K.

EXAMPLE 6

A 700 nm thick layer of $CoAl_2O_4$ was applied on the dielectric layer 4 of a front plate 1 comprising a glass plate 3, discharge electrodes 6, 7, and a dielectric layer 4 by electron beam vapor deposition of CoO and $Al_2O_3$ in a high-vacuum device. The dielectric layer 4 comprised PbO-containing glass, and the two discharge electrodes 6,7 were made of ITO. Then the front plate 1 was used together with a carrier plate 2 and a xenon-containing gas mixture to build a plasma picture screen. The white color point of the plasma picture screen was 7600 K.

TABLE 1

Luminance contrast performance gain (LCP gain), color temperature, white color point, and luminance of a plasma picture screen as a function of the thickness of a protective layer 5 of $CoAl_2O_4$.

| Thickness [μm] | LCP gain [%] | Color temperature [K] | White color point [x, y] | Luminance [$CDm^{-2}$] |
|---|---|---|---|---|
| 0 | 0 | 5966 | 0.3227, 0.3324 | 379.5 |
| 0.173 | 2.6 | 6132 | 0.3193, 0.3327 | 341.7 |
| 0.272 | 3.8 | 6389 | 0.3146, 0.3301 | 332.2 |
| 0.487 | 6.8 | 7161 | 0.3024, 0.3227 | 305.4 |
| 0.728 | 9.7 | 8109 | 0.2901, 0.3153 | 282.1 |
| 1.570 | 15.3 | >11000 | 0.2517, 0.2888 | 214.5 |

$(Y,Gd)BO_3$:Eu was used as the red-emitting phosphor, $ZM_2SiO_4$:Mn as the red-emitting phosphor, and $BaMgAl_{10}O_{17}$:Eu as the blue-emitting phosphor. The gas mixture contained 5% Xe by vol. and 95% Ne by vol.

What is claimed is:

1. A plasma picture screen provided with a front plate (1) which comprises a glass plate on which a dielectric layer (4) and a protective layer (5) are provided, with a carrier plate (2) carrying a phosphor (9), with a ribbed structure (1L) which divides the space between the front plate (1) and the carrier plate (L) into plasma cells filled with a gas, and with one or more electrode arrays (6, 7, 10,) on the front plate (1) and the carrier plate (L) for generating corona discharges in the plasma cells, wherein the front plate (1) has a blue layer on its side facing the plasma cells.

2. A plasma picture screen as claimed in claim 1, characterized in that the blue layer is the protective layer (5).

3. A plasma picture screen as claimed in claim 2, characterized in that the blue layer is structured and extends parallel to the electrodes (6, 7) on the front plate (1).

4. A plasma picture screen as claimed in claim 1, characterized in that the blue layer is the dielectric layer (4).

5. A plasma picture screen as claimed in claim 1, characterized in that the blue layer is provided on the glass plate (3) and on the electrodes (6, 7) of the front plate (1).

6. A plasma picture screen as claimed in claim 1, characterized in that the blue layer contains colorant particles s elected from the group $CoAl_2O_4$ and blue ultramarines.

* * * * *